US012209799B2

(12) United States Patent
Tian et al.

(10) Patent No.: US 12,209,799 B2
(45) Date of Patent: Jan. 28, 2025

(54) CONTROL METHOD FOR REFRIGERATOR AND REFRIGERATOR

(71) Applicant: BSH Hausgeraete GmbH, Munich (DE)

(72) Inventors: Yong Tian, Nanjing (CN); Qiwu Zhu, Chuzhou (CN); Weizhong Zhu, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 245 days.

(21) Appl. No.: 17/916,186

(22) PCT Filed: Mar. 15, 2021

(86) PCT No.: PCT/EP2021/056499
§ 371 (c)(1),
(2) Date: Sep. 30, 2022

(87) PCT Pub. No.: WO2021/197817
PCT Pub. Date: Oct. 7, 2021

(65) Prior Publication Data

US 2023/0175770 A1 Jun. 8, 2023

(30) Foreign Application Priority Data

Mar. 31, 2020 (CN) ..... 202010243634.5

(51) Int. Cl.
*F25D 29/00* (2006.01)
*F25D 11/02* (2006.01)
(Continued)

(52) U.S. Cl.
CPC ..... *F25D 29/003* (2013.01); *F25D 11/02* (2013.01); *F25D 17/042* (2013.01);
(Continued)

(58) Field of Classification Search
CPC ..... F25D 9/003; F25D 17/045; F25D 17/067; F25D 21/08; F25D 29/005;
(Continued)

(56) References Cited

U.S. PATENT DOCUMENTS

2003/0182962 A1 10/2003 Shim et al.
2009/0193826 A1* 8/2009 Yasugi ..... F25D 23/12 62/159
(Continued)

FOREIGN PATENT DOCUMENTS

CN 106152674 1/2019
DE 102012221296 A1 5/2014
(Continued)

*Primary Examiner* — Marc E Norman
(74) *Attorney, Agent, or Firm* — Laurence A. Greenberg; Werner H. Stemer; Ralph E. Locher

(57) ABSTRACT

A control method for a refrigerator and a refrigerator are provided. The refrigerator includes a compartment, an evaporator, and a heating module. The method includes: acquiring a current temperature of the compartment; and adjusting an operating power of the heating module according to the current temperature, so that the heating module heats the compartment to a target temperature according to the operating power, where different temperature ranges correspond to different operating powers.

17 Claims, 5 Drawing Sheets

(51) Int. Cl.
*F25D 17/04* (2006.01)
*F25D 17/06* (2006.01)
*F25D 21/08* (2006.01)

(52) U.S. Cl.
CPC ..... *F25D 17/065* (2013.01); *F25D 17/067* (2013.01); *F25D 21/08* (2013.01); *F25D 29/005* (2013.01); *F25D 2317/04111* (2013.01); *F25D 2400/02* (2013.01); *F25D 2400/16* (2013.01); *F25D 2600/06* (2013.01); *F25D 2700/121* (2013.01)

(58) Field of Classification Search
CPC ..... F25D 2317/04111; F25D 2400/02; F25D 2600/06; F25D 2700/12; F25D 2700/121; F25D 11/02; F25D 17/065
See application file for complete search history.

(56) References Cited

U.S. PATENT DOCUMENTS

| | | | | |
|---|---|---|---|---|
| 2012/0222436 | A1* | 9/2012 | Li | F25D 29/00 62/89 |
| 2013/0086928 | A1* | 4/2013 | Cho | F25D 21/006 62/155 |
| 2016/0356539 | A1* | 12/2016 | Chung | F25D 21/04 |
| 2018/0106526 | A1* | 4/2018 | Kim | F25D 21/08 |
| 2018/0313596 | A1* | 11/2018 | Lee | F25D 21/008 |

FOREIGN PATENT DOCUMENTS

| | | | |
|---|---|---|---|
| JP | H10332242 | A | 12/1998 |
| JP | 2000220933 | A | 8/2000 |

* cited by examiner

CONTROL METHOD FOR REFRIGERATOR AND REFRIGERATOR

FIELD AND BACKGROUND OF THE INVENTION

Embodiments of the present invention relate to the technical field of refrigeration appliances, and specifically, to a control method for a refrigerator and a refrigerator.

As requirements for food storage conditions by refrigerator users become more diverse and personalized, refrigerators with variable-temperature compartments that are adjusted in a large range across a plurality of temperature areas are becoming increasingly popular with users.

The existing refrigerators with variable-temperature compartments may be roughly classified into two categories. A first category is a single-cycle refrigerator in which a variable-temperature compartment and a freezing compartment share one evaporator. The refrigerator disclosed in the Chinese Patent Application No. 201210062354.X is used as an example. An air duct and a ventilation door are connected between a variable-temperature compartment and a freezing compartment, and variable-temperature compartment is heated by using a temperature compensation heating wire at a low power. Due to the low power, a heating speed of the variable-temperature compartment of such a refrigerator is quite slow. In addition, a single-cycle design inevitably leads to an odor problem, especially when the variable-temperature compartment is set to a high-characteristic temperature compartment type, for example, a refrigerating compartment or a cooling compartment.

A second category is a multi-cycle refrigerator with evaporators independent of each other. The refrigerator disclosed in the Chinese patent CN106152674B is used as an example. The variable-temperature compartment is heated by using a defrosting heating wire of the evaporator of the variable-temperature compartment. This heating manner means that the evaporator is defrosted. This allows a large amount of water vapour to enter the compartment, and higher air humidity is more conducive to generate microorganisms. Therefore, this heating manner tends to cause spoilage of food such as vegetables and fruits stored in the variable-temperature compartment. In addition, because a power of the defrosting heating wire of the evaporator is generally large, and it is difficult to effectively and accurately control, an excessive temperature rise of the variable-temperature compartment is extremely easy when the defrosting heating wire is used for heating, and it is difficult to maintain a slighter temperature fluctuation of the variable-temperature compartment.

SUMMARY OF THE INVENTION

An objective of embodiments of the present invention is to provide an improved refrigerator and a control method for a refrigerator.

Therefore, an embodiment of the present invention provides a control method for a refrigerator. The refrigerator includes a compartment, an evaporator, and a heating module. The control method includes: acquiring a current temperature of the compartment; and adjusting an operating power of the heating module according to the current temperature, so that the heating module heats the compartment to a target temperature according to the operating power, where different temperature ranges correspond to different operating powers.

The temperature of the compartment of the refrigerator can be quickly and accurately adjusted by using the solution of this embodiment. Specifically, the operating power of the heating module is adjusted according to the current temperature range of the compartment, so that the heating module can operate at a power more suitable for a current state of the compartment. The solution of this embodiment is conducive to provide a storage environment with a wide temperature range that is flexibly adjusted for a user.

Optionally, the control method further includes: when the current temperature of the compartment reaches a first preset temperature and the first preset temperature is lower than the target temperature, or when the heating module operates beyond a first preset time, pausing the operation of the heating module, and starting dehumidification for the compartment. Therefore, by means of temperature control or fixed-time control, the dehumidification is performed during the compartment heating, to reduce the humidity of the compartment, and prevent stored items placed in the compartment from deterioration and corruption.

For example, when the heating module includes a defrosting heating wire disposed in the evaporator compartment, to avoid excessively large humidity in the compartment during the heating, the dehumidification may be performed on the compartment when the temperature of the compartment is close to the target temperature.

Optionally, the dehumidification includes the following steps: starting the evaporator for refrigeration, and acquiring an evaporator temperature of the evaporator; and when the evaporator temperature decreases to a preset dehumidification temperature, starting an air blower to operate to blow air to circulate between the compartment and the evaporator. Therefore, the dehumidification is performed on the compartment by using a characteristic of a moisture absorption function when a temperature of the evaporator is lower than a specified temperature, to reduce the humidity of the compartment.

Optionally, the control method further includes the following steps: during the dehumidification for the compartment, when the current temperature of the compartment reaches a preset dehumidification stopping temperature, or when the dehumidification is continued to reach a second preset time, stopping the dehumidification for the compartment and stopping the operation of the air blower. Therefore, a stopping time of the dehumidification is determined by means of the temperature control or the fixed-time control, to actively stop the dehumidification when the humidity of the compartment reaches an appropriate level.

For example, the preset dehumidification stopping temperature may be determined according to a condensation temperature under a current environmental condition of the compartment, to stop the dehumidification before the dehumidification effect is deteriorated.

Optionally, a difference between the first preset temperature and the target temperature is less than 5° C. to 10° C., to start the dehumidification when the temperature of the compartment is close to the target temperature. Specifically, the dehumidification is started when the temperature of the compartment rises near the target temperature, and the humidity of the compartment may be adjusted to an appropriate level through single-time dehumidification instead of multi-time repeated dehumidification, thereby reducing the power consumption of the refrigerator.

Optionally, the adjusting an operating power of the heating module according to the current temperature, so that the heating module heats the compartment to a target temperature according to the operating power includes: when the current temperature of the compartment is lower than the first preset temperature, controlling the heating module to heat the compartment according to a first operating power, where the first preset temperature is lower than the target temperature; and when the current temperature of the compartment reaches the first preset temperature, controlling the heating module to heat the compartment according to a second operating power, where the second operating power is lower than the first operating power. Therefore, when a difference between the current temperature of the compartment and the target temperature is relatively large, the operating power of the heating module can be appropriately increased, to quickly rise the temperature, and shorten the time required for a temperature change. When the current temperature of the compartment is gradually close to the target temperature, the operating power of the heating module can be appropriately decreased, to effectively avoid an excessive temperature rise. Further, during low-power heating, the temperature of the compartment can be fine adjusted, to accurately rise the temperature of the compartment to the target temperature. This has advantages of high control precision and a slight temperature fluctuation, and is conducive to accurately maintain the temperature of the compartment at the target temperature.

Optionally, the controlling the heating module to heat the compartment according to a first operating power includes: intermittently controlling the heating module to run according to the first operating power to heat the compartment. Because the heating effect of the heating module has hysteresis, and the heating of the heating module on the compartment gradually acts on the whole compartment from a partial portion of the compartment, a situation that local temperatures in the compartment are uneven during heating may exist. In this case, a sufficient response time is provided through an intermittently heating mode, so that heat provided by the heating module can be sufficiently radiated to each area of the compartment, to prevent the measured current temperature of the compartment from being falsely high or low caused by the uneven local temperatures in the compartment. Further, more accurate temperature measurement results are conducive to reasonably determine the operating power adjustment time of the heating module, so that the heating module can be accurately switched to the second operating power at the first preset temperature.

Optionally, a time interval between two successive runnings of the heating module is related to the number of times of runnings of the heating module, so that heat generated and accumulated during previous runnings of the heating module can have sufficient response time to be transferred to the compartment. Therefore, the temperature evenness in the compartment is better ensured, so that the measurement result for the temperature of the compartment can more accurately reflect an actual temperature level of the compartment.

Optionally, the control method further includes: during the controlling the heating module to heat the compartment according to a first operating power, when the current temperature rises to the first preset temperature, controlling the heating module to switch to heat the compartment at the second operating power; and during the controlling the heating module to heat the compartment according to a second operating power, when the current temperature continues to rise beyond a second preset temperature, controlling the heating module to stop heating the compartment, where the second preset temperature is higher than the first preset temperature, and the second preset temperature is lower than the target temperature. Because the first operating power is higher, a variation of the temperature of the compartment within a unit time is correspondingly larger. Therefore, the heating module is controlled to first heat the compartment according to a higher first operating power, so that the compartment is quickly heated to a temperature near the target temperature.

Further, considering that there may be a delay in the measurement of the temperature of the compartment, and a time is also required to achieve the temperature evenness in the each area in the compartment, if the heating module stops running after heating the compartment to the target temperature by using the first operating power all the time, an actual temperature in the compartment may have been beyond the target temperature. Therefore, in the solution of this embodiment, when the temperature of the compartment reaches the first preset temperature, the heating module is controlled to switch to heat the compartment at a smaller second operating power, so that the temperature of the compartment can slowly rise to the target temperature. Because the second operating power is lower, a variation of the temperature of the compartment within a unit time is correspondingly smaller. Therefore, the fluctuation of the temperature of the compartment is slight, and a situation that the temperature rises sharply does not exist, so that it is possible for the temperature of the compartment to accurately be the target temperature.

Further, the heating module is switched off in advance before the temperature of the compartment reaches the target temperature, to reserve the sufficient response time for a change of the temperature of the compartment, so as to ensure that the temperature of the compartment accurately reaches and is maintained at the target temperature. It is better to avoid that the compartment is heated beyond the target temperature.

Optionally, the controlling the heating module to heat the compartment according to a second operating power includes: intermittently controlling the heating module to run according to the second operating power to heat the compartment; and during the running of the heating module, controlling the air blower of the refrigerator to switch on to blow air to circulate between the compartment and the heating module. Therefore, the sufficient response time is provided through an intermittently heating mode, and the temperature radiation speed is improved in combination with the air blower, so that the heat provided by the heating module can be sufficiently and quickly radiated to the each area of the compartment.

An embodiment of the present invention further provides a control method for a refrigerator. The refrigerator includes a compartment and an evaporator. The refrigerator further includes a high-power heating module and a low-power heating module, and the control method includes: acquiring a current temperature of the compartment of the refrigerator; and successively controlling the high-power heating module and the low-power heating module to operate according to the current temperature of the compartment, so as to gradually rise the temperature of the compartment to a target temperature, where an operating power of the high-power heating module is a first operating power, an operating power of the low-power heating module is a second operating power, and the second operating power is lower than the first operating power. At the initial stage of heating, the high-power heating module is controlled to operate, to quickly rise the temperature and shorten the time required for the temperature change. At the middle stage of heating, the low-power heating module is switched to fine adjust the temperature of the compartment, so that the temperature of the compartment accurately rises to the target temperature. Therefore, that the temperature of the compartment of the refrigerator is quickly and accurately adjusted is conducive to provide a storage environment with a wide temperature range that is flexibly adjusted for a user. Optionally, during the successively controlling the high-power heating module and the low-power heating module to operate according to the current temperature of the compartment, the control method further includes: when the high-power heating module is such controlled that the current temperature of the compartment reaches a first preset temperature, or when the high-power heating module operates beyond a first preset time, stopping the operation of the high-power heating module, and starting the low-power heating module to continue heating the compartment. Therefore, when the current temperature of the compartment is gradually close to the target temperature, the low-power heating module is switched, to effectively avoid the excessive temperature rise of the compartment based on the advantages of the high control precision and the slight temperature fluctuation of the low-power heating module.

Optionally, during the successively controlling the high-power heating module and the low-power heating module to operate according to the current temperature of the compartment, the control method further includes: when the high-power heating module is such controlled that the current temperature of the compartment reaches a first preset temperature, or when the high-power heating module operates beyond a first preset time, stopping the operation of the high-power heating module, and starting dehumidification for the compartment; and after the dehumidification is completed, starting the low-power heating module to continue heating the compartment. Therefore, by means of temperature control or fixed-time control, the dehumidification is performed during the compartment heating, to reduce the humidity of the compartment, and prevent stored items placed in the compartment from deterioration and corruption. Further, the low-power heating module is switched to continue heating after the dehumidification is completed, so that the compartment can be heated to the target temperature in a humidity environment that meets requirements.

Optionally, the dehumidification includes the following steps: starting the evaporator for refrigeration, and acquiring an evaporator temperature of the evaporator; and when the evaporator temperature decreases to a preset dehumidification temperature, starting an air blower to operate to blow air to circulate between the compartment and the evaporator. Therefore, the dehumidification is performed on the compartment by using a characteristic of a moisture absorption function when a temperature of the evaporator is lower than a specified temperature, to reduce the humidity of the compartment.

Optionally, the control method further includes: during the dehumidification for the compartment, when the current temperature of the compartment reaches a preset dehumidification stopping temperature, or when the dehumidification is continued to reach a second preset time, stopping the dehumidification for the compartment and stopping the operation of the air blower. Therefore, a stopping time of the dehumidification is determined by means of the temperature control or the fixed-time control, to actively stop the dehumidification when the humidity of the compartment reaches an appropriate level.

For example, the preset dehumidification stopping temperature may be determined according to a condensation temperature under a current environmental condition of the compartment, to stop the dehumidification before the dehumidification effect is deteriorated.

Optionally, the successively controlling the high-power heating module and the low-power heating module to operate according to the current temperature of the compartment includes: when the current temperature of the compartment is lower than the first preset temperature, controlling the high-power heating module to operate to heat the compartment; and during the operation of the high-power heating module, when the current temperature reaches the first preset temperature, stopping the high-power heating module, and controlling the low-power heating module to operate to continue heating the compartment. Therefore, when a difference between the current temperature of the compartment and the target temperature is relatively large, the temperature quickly rises and the time required for the temperature change is shortened based on the high-power heating module. When the current temperature of the compartment is gradually close to the target temperature, an excessive temperature rise is effectively avoided based on the low-power heating module. Further, during low-power heating, the temperature of the compartment can be fine adjusted, to accurately rise the temperature of the compartment to the target temperature. This has the advantages of high control precision and a slight temperature fluctuation, and is conducive to accurately maintain the temperature of the compartment at the target temperature.

Optionally, the controlling the high-power heating module to operate to heat the compartment includes: intermittently controlling the high-power heating module to run to heat the compartment. Because the heating effect of the heating module has hysteresis, and the heating of the heating module on the compartment gradually acts on the whole compartment from a partial portion of the compartment, a situation that local temperatures in the compartment are uneven during heating may exist. In this case, a sufficient response time is provided through an intermittently heating mode, so that heat provided by the heating module can be sufficiently radiated to each area of the compartment, to prevent the measured current temperature of the compartment from being falsely high or low caused by the uneven local temperatures in the compartment. Further, more accurate temperature measurement results are conducive to reasonably determine a switching time of the two heating modules, to accurately switch to, at the first preset temperature, the low-power heating module to operate.

Optionally, a time interval between two successive runnings of the high-power heating module is related to the number of times of runnings of the high-power heating module, so that heat generated and accumulated during previous runnings of the heating module can have sufficient response time to be transferred to the compartment. Therefore, the temperature evenness in the compartment is better ensured, so that the measurement result for the temperature of the compartment can more accurately reflect an actual temperature level of the compartment.

Optionally, a running duration of each running of the high-power heating module is determined according to an evaporator temperature of the evaporator. Further, the evaporator temperature is related to a thickness of frost on the evaporator.

Optionally, before the controlling the high-power heating module to operate to heat the compartment, the control method further includes: controlling the high-power heating module to run to perform a preheating operation; controlling an air blower related to the compartment to switch on to blow air to circulate between the high-power heating module and the compartment; and if the current temperature of the compartment is still lower than the first preset temperature after the preheating operation is completed, controlling the high-power heating module to operate to heat the compartment. The preheating operation may also be understood as a pre-defrosting operation, and can play a role of warming the machine, so that when the high-power heating module is subsequently controlled to operate to heat the compartment, the heat provided by the high-power heating module can be quickly radiated to the compartment.

Further, the added preheating operation is further conducive to reasonably determine subsequent control logic. For example, when the temperature of the compartment can rise to the first preset temperature through the preheating operation, the low-power heating module may be directly controlled to fine adjust the temperature. In another example, when the temperature of the compartment is still relatively low after the preheating is completed, the high-power heating module is controlled to heat to quickly rise the temperature.

Optionally, the if the current temperature of the compartment is still lower than the first preset temperature after the preheating operation is completed, controlling the high-power heating module to operate to heat the compartment includes: waiting for a first preset response duration after the preheating operation is completed; and if the current temperature of the compartment is still lower than the first preset temperature after the first preset response duration is waited for, controlling the high-power heating module to operate to heat the compartment. Therefore, the sufficient response time is also provided after the preheating is completed, to ensure that the heat of the high-power heating module is sufficiently radiated to the compartment.

Further, the first preset response duration may be determined according to the evaporator temperature. This depends on the amount of frost on the evaporator.

Optionally, during the controlling the high-power heating module to operate to heat the compartment, the air blower related to the compartment is in an on state, to increase the radiation speed of the heat between the high-power heating module and the compartment and the heat in the each area of the compartment.

Optionally, the controlling the low-power heating module to operate to heat the compartment includes: intermittently controlling the low-power heating module to run to heat the compartment; and during the running of the low-power heating module, controlling the air blower related to the compartment to switch on to blow air to flow in the compartment. Therefore, the sufficient response time is provided through an intermittently heating mode, and the temperature radiation speed is improved in combination with the air blower, so that the heat provided by the low-power heating module can be sufficiently and quickly radiated to the each area of the compartment.

Optionally, a smaller second operating power indicates a greater ratio of a single running duration of the low-power heating module to a time interval between two successive runnings of the low-power heating module, and therefore, the temperature fluctuation is reduced.

Optionally, after the stopping the high-power heating module and before the controlling the low-power heating module to operate, the successively controlling the high-power heating module and the low-power heating module to operate according to the current temperature of the compartment further includes: waiting for a second preset response duration after the high-power heating module is switched off; and if the current temperature of the compartment is still lower than the first preset temperature after the second preset response duration is waited for, controlling the low-power heating module to operate. Therefore, determining whether to continue heating after waiting for the sufficient response time is conducive to more accurately adjust the temperature of the compartment.

Optionally, the control method further includes: during the controlling the low-power heating module to operate, when the current temperature of the compartment is higher than a second preset temperature, controlling the low-power heating module to stop heating the compartment, where the second preset temperature is higher than the first preset temperature, and the second preset temperature is lower than the target temperature. Therefore, the low-power heating module is switched off in advance before the temperature of the compartment reaches the target temperature, to reserve the sufficient response time for a change of the temperature of the compartment, so as to ensure that the temperature of the compartment accurately reaches and is maintained at the target temperature. It is better to avoid that the compartment is heated beyond the target temperature.

An embodiment of the present invention further provides a control method for a refrigerator. The refrigerator includes a compartment and a heating module. The control method includes: controlling the heating module to operate intermittently, to heat the compartment to a target temperature. Considering that the heating effect of the heating module has hysteresis, in the solution of this embodiment, the sufficient response time is provided through an intermittently heating mode, so that the heat provided by the heating module can be sufficiently radiated to the each area of the compartment, and the temperature of the compartment can accurately rise to the target temperature and be maintained near the temperature.

Optionally, a lower power of the heating module indicates a larger $t_{on}/t_{off}$ ratio of the heating module. The $t_{on}/t_{off}$ ratio is a ratio of the single running duration to the time interval between the two successive runnings. Therefore, it is conducive to reduce the temperature fluctuation.

Optionally, the controlling the heating module to operate intermittently, to heat the compartment to a target temperature includes: acquiring a current temperature of the compartment; and controlling, according to the current temperature, the heating module to operate intermittently, to heat the compartment to the target temperature. Considering that the heating effect of the heating module has hysteresis, in the solution of this embodiment, the sufficient response time is provided through an intermittently heating mode, so that the heat provided by the heating module can be sufficiently radiated to the each area of the compartment, and the temperature of the compartment can accurately rise to the target temperature and be maintained near the temperature.

Optionally, the controlling, according to the current temperature, the heating module to operate intermittently, to heat the compartment to the target temperature includes: when the current temperature of the compartment is lower than the first preset temperature, intermittently controlling the heating module to heat the compartment according to a first operating power, where the first preset temperature is lower than the target temperature; and when the current temperature of the compartment reaches the first preset temperature, intermittently controlling the heating module to run to heat the compartment according to a second operating power, where the second operating power is lower than the first operating power. Therefore, when a difference between the current temperature of the compartment and the target temperature is relatively large, the operating power of the heating module can be appropriately increased, to quickly rise the temperature, and shorten the time required for a temperature change. When the current temperature of the compartment is gradually close to the target temperature, the operating power of the heating module can be appropriately decreased, to effectively avoid an excessive temperature rise. Further, during low-power heating, the temperature of the compartment can be fine adjusted, to accurately rise the temperature of the compartment to the target temperature. This has the advantages of high control precision and a slight temperature fluctuation, and is conducive to accurately maintain the temperature of the compartment at the target temperature.

Optionally, the control method further includes: when the current temperature of the compartment reaches a first preset temperature and the first preset temperature is lower than the target temperature, or when the heating module operates beyond a first preset time, pausing the operation of the heating module, and starting dehumidification for the compartment. Therefore, by means of temperature control or fixed-time control, dehumidification is performed during the compartment heating, to reduce the humidity of the compartment, and prevent stored items placed in the compartment from deterioration and corruption.

An embodiment of the present invention further provides a refrigerator, including: a compartment; a high-power heating module, configured to heat the compartment according to a first operating power; a low-power heating module, configured to heat the compartment according to a second operating power, where the second operating power is lower than the first operating power; a temperature sensor, disposed in the compartment and configured to acquire a current temperature of the compartment; and a control module, coupled to the high-power heating module, the low-power heating module, and the temperature sensor respectively, where the control module is configured to receive a user instruction and perform the foregoing control method in response to the user instruction, to adjust the temperature of the compartment to a target temperature indicated by the user instruction. At the initial stage of heating, the high-power heating module is controlled to operate, to quickly rise the temperature and shorten the time required for the temperature change. At the middle stage of heating, the low-power heating module is switched to fine adjust the temperature of the compartment, so that the temperature of the compartment accurately rises to the target temperature. Therefore, that the temperature of the compartment of the refrigerator is quickly and accurately adjusted is conducive to provide a storage environment with a wide temperature range that is flexibly adjusted for a user.

Optionally, the high-power heating module is disposed in the compartment, so that heat can be rapidly radiated to the compartment.

Optionally, the refrigerator further includes: an evaporator compartment, where the evaporator compartment is provided with an evaporator, and the high-power heating module is disposed in the evaporator compartment. For example, the high-power heating module may reuse a defrosting heating wire disposed in the evaporator compartment, to quickly rise the temperature of the compartment without changing a structure of the refrigerator.

Optionally, the refrigerator further includes: an air blower, disposed on an air duct in communication with the evaporator compartment and the compartment. The air blower is configured to blow air to circulate between the evaporator compartment and the compartment, to promote the radiation of the heat to the compartment.

Optionally, the low-power heating module is disposed in the compartment, so that heat can be rapidly radiated to the compartment.

Optionally, the low-power heating module is disposed in at least a partial area of a bottom portion of the compartment. On one hand, an internal space of the refrigerator can be occupied as little as possible. One the other hand, it can be ensured that the heat is effectively transferred to the compartment. For example, the low-power heating module may be disposed in an inner container at a bottom portion of the compartment.

An embodiment of the present invention further provides a refrigerator, including: a compartment; a heating module, where the heating module includes a plurality of sets of heating units, the plurality of sets of heating units are connected through a control switch, and operating powers of the heating module are different when the control switch switches on and off; a temperature sensor, disposed in the compartment and configured to acquire a current temperature of the compartment; and a control module, coupled to the heating module and the temperature sensor respectively, where the control module is configured to receive a user instruction and perform the foregoing control method in response to the user instruction, to adjust the temperature of the compartment to a target temperature indicated by the user instruction. The temperature of the compartment of the refrigerator can be quickly and accurately adjusted by using the solution of this embodiment. Specifically, a quantity of heating units in an operation state is adjusted according to the current temperature range of the compartment, to adjust the operating power of the heating module, so that the heating module can operate at a power more suitable for a current state of the compartment. The solution of this embodiment is conducive to provide a storage environment with a wide temperature range that is flexibly adjusted for a user.

Figure 1:
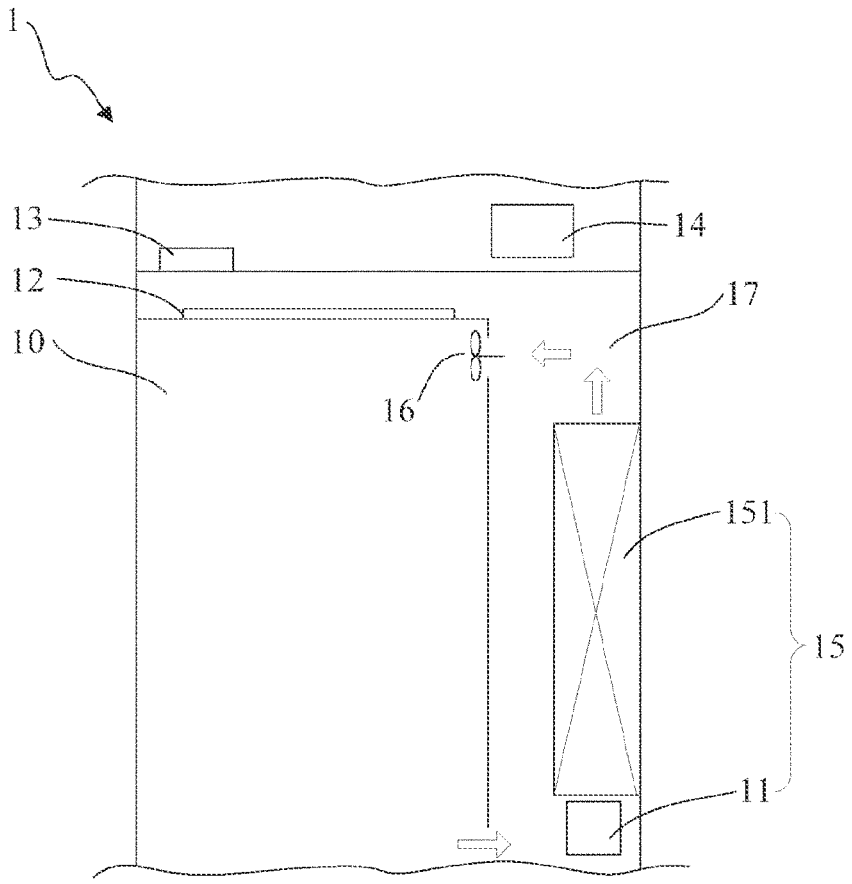
FIG. 1 is a schematic diagram of a principle of a first refrigerator according to an embodiment of the present invention.

1 and 2—refrigerator; 10—compartment; 11—high-power heating module; 12—low-power heating module; 13—temperature sensor; 14—control module; 15—evaporator compartment; 151—evaporator; 16—air blower; 17—air duct; 21—heating module; 210—heating unit; and 211—control switch.

DETAILED DESCRIPTION OF THE INVENTION

As described in the related art, a structural design and control logic of an existing refrigerator have a plurality of defects, resulting in a poor effect of adjusting a temperature of a compartment such as a variable-temperature compartment.

To resolve the foregoing technical problems, an embodiment of the present invention provides a control method for a refrigerator. The refrigerator includes a compartment, an evaporator, and a heating module. The control method includes: acquiring a current temperature of the compartment; and adjusting an operating power of the heating module according to the current temperature, so that the heating module heats the compartment to a target temperature according to the operating power, where different temperature ranges correspond to different operating powers.

The temperature of the compartment of the refrigerator can be quickly and accurately adjusted by using the solution of this embodiment. Specifically, the operating power of the heating module is adjusted according to the current temperature range of the compartment, so that the heating module can operate at a power more suitable for a current state of the compartment. The solution of this embodiment is conducive to provide a storage environment with a wide temperature range that is flexibly adjusted for a user.

Next, the embodiments of the present invention are described in detail with reference to accompany drawings. Same parts in the figures are denoted by same reference numerals. The embodiments are merely examples. Certainly, structures shown in the different embodiments may be partially replaced or combined. In different embodiments, the description of the same content as that in the first embodiment is omitted, and only the differences will be described. In particular, the same functions or effects produced by the same structures will not be mentioned one by one for each embodiment.

To make the foregoing objectives, features, and advantages of the present invention clearer and easier to understand, specific embodiments of the present invention are described below in detail with reference to the accompanying drawings.

Figure 2:
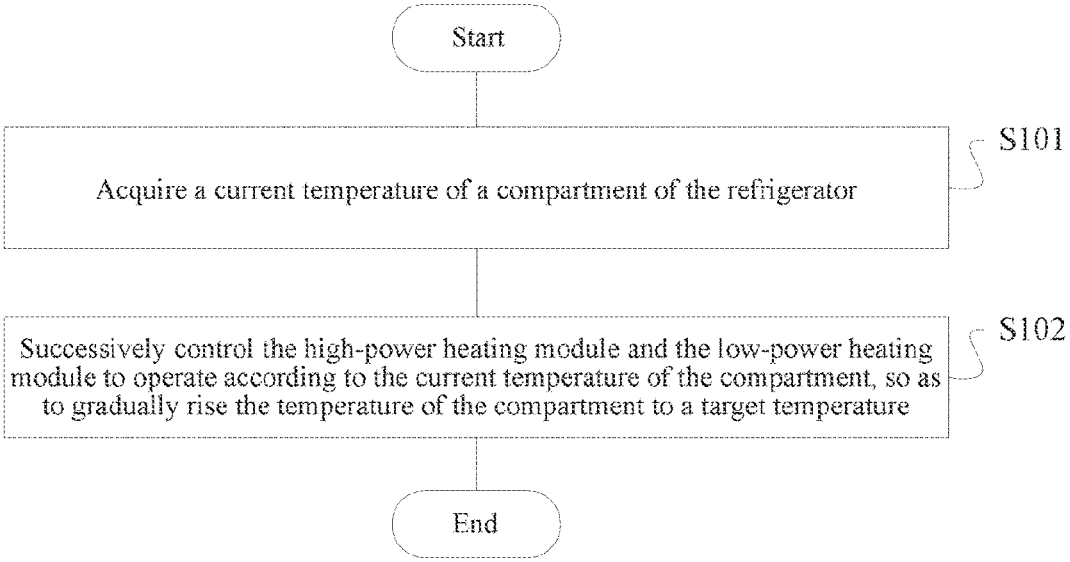
FIG. 2 is a flowchart of a control method for the refrigerator shown in FIG. 1.

FIG. 1 is a schematic diagram of a principle of a first refrigerator according to an embodiment of the present invention. FIG. 2 is a flowchart of a control method for the refrigerator shown in FIG. 1.

A temperature of a compartment of a refrigerator 1 shown in FIG. 1 can be quickly and accurately adjusted by using the solution of the present invention. It should be noted that, FIG. 1 merely exemplarily shows a specific structure of a compartment 10 controlled by using the control method shown in FIG. 2.

For example, the compartment 10 may be a variable-temperature compartment. The variable-temperature compartment is a compartment that can be adjusted in a large range across a plurality of temperature areas according to actual requirements. A temperature range adjusted in the large range across the plurality of temperature areas may be located between −18° C. and 14° C., and is more conducive to keep different foods such as tropical fruits, vegetables, meat, fish, and egg and milk fresh. In actual application, the compartment 10 may be another area of the refrigerator 1 where a temperature needs to be adjusted.

In this embodiment, the circulation of the compartments 10 of the refrigerator 1 may be independent of each other, to resolve odor and temperature confusion problems.

Specifically, referring to FIG. 1, in this embodiment, the refrigerator 1 may include: a compartment 10; a high-power heating module 11, configured to heat the compartment 10 according to a first operating power; a low-power heating module 12, configured to heat the compartment 10 according to a second operating power, where the second operating power is lower than the first operating power; a temperature sensor 13, disposed in the compartment 10 and configured to acquire a current temperature of the compartment 10; and a control module 14, coupled to the high-power heating module 11, the low-power heating module 12, and the temperature sensor 13 respectively, where the control module 14 is configured to receive a user instruction and perform the control method described in the embodiments shown in FIG. 2 in response to the user instruction, to adjust the temperature of the compartment 10 to a target temperature indicated by the user instruction.

Referring to FIG. 2, the control method for the refrigerator 1 may include the following steps: Step S101. Acquire a current temperature of the compartment 10 of the refrigerator 1.

Step S102. Successively control the high-power heating module 11 and the low-power heating module 12 to operate according to the current temperature of the compartment 10, so as to gradually rise the temperature of the compartment 10 to a target temperature.

In a specific implementation, referring to FIG. 1, the temperature sensor 13 may be disposed at a top portion of the compartment 10, for example, may be disposed on a partition plate between a variable-temperature compartment and a refrigerating compartment above the variable-temperature compartment. During specific implementation, the temperature sensor 13 may be alternatively disposed on another suitable position in the refrigerator 1, to accurately acquire a real-time temperature of the compartment 10. For example, the temperature sensor 13 may be alternatively disposed on a side wall of the compartment 10, a surface of an air duct 17, and the like.

In step S101, the temperature of the compartment 10 may be obtained through sensing by the temperature sensor 13, and the current temperature of the compartment 10 is obtained through processing such as calculation.

For example, there may be a plurality of temperature sensors 13, and the plurality of temperature sensors are distributed in different areas of the compartment 10. The current temperature of the compartment 10 is obtained after integration processing is performed on acquisition results of temperatures of the temperature sensors 13.

In a specific implementation, the refrigerator 1 may further include: an evaporator compartment 15, where the evaporator compartment 15 is provided with an evaporator 151, and the high-power heating module 11 may be disposed in the evaporator compartment 15. For example, the high-power heating module 11 may reuse a defrosting heating wire disposed in the evaporator compartment 15, to quickly rise the temperature of the compartment 10 without changing a structure of the refrigerator 1.

In a variant embodiment, the high-power heating module 11 may be disposed in the compartment 10, so that heat can be rapidly radiated to the compartment 10.

In a specific implementation, the refrigerator 1 may further include: an air blower 16, disposed on an air duct 17 in communication with the evaporator compartment 15 and the compartment 10. The air blower 16 is configured to blow air to circulate (shown by thick arrows in FIG. 1) between the evaporator compartment 15 and the compartment 10, to promote the radiation of the heat to the compartment 10.

In a specific implementation, the low-power heating module 12 may be disposed in the compartment 10, so that heat can be rapidly radiated to the compartment 10.

For example, the low-power heating module 12 may be a compensation heating wire, and is disposed in at least a partial area of a bottom portion of the compartment 10. On the one hand, an internal space of the refrigerator 1 can be occupied as little as possible. One the other hand, it can be ensured that the heat is effectively transferred to the compartment 10. Specifically, the low-power heating module 12 may be laid flat in an inner container at a bottom portion of the compartment 10.

In another example, the low-power heating module 12 may be disposed on an inner surface of the air duct 17, and the heat of the low-power heating module is blown to the compartment 10 by using the air blower 16.

The high-power heating module 11 has high radiation heat on the compartment 10 within a unit time, and the temperature of the compartment 10 fluctuates greatly. The low-power heating module 12 has low radiation heat on the compartment 10 within a unit time, and the temperature of the compartment 10 fluctuates slightly.

In a specific implementation, the control module 14 may be disposed on any suitable position in the refrigerator 1, for example, a partition plate between the variable-temperature compartment and another compartment of the refrigerator 1. FIG. 1 merely exemplarily shows a position of the control module 14.

Specifically, the control module 14 may be coupled to components such as the high-power heating module 11, the low-power heating module 12, the evaporator 151, and the air blower 16, to control the corresponding components to perform corresponding actions when the method technical solution of the embodiments is performed.

In a specific implementation, the refrigerator 1 may further include: an input module (not shown), configured to receive the user instruction and transfer the user instruction to the control module 14. For example, the input module may be a touchscreen disposed on an outer surface of the refrigerator 1.

The input module may be integrated with the control module 14.

Further, the user instruction may include a specific value or a temperature range of the target temperature.

Alternatively, the user instruction may include a running mode of the compartment 10, for example, whether the compartment 10 runs according to a refrigerating compartment or a freezing compartment. The control module 14 may voluntarily determine a corresponding target temperature according to the instructed running mode in response to the received user instruction.

In view of the above, by using the solution of this embodiment, at the initial stage of heating, the high-power heating module 11 is controlled to operate, to quickly rise the temperature and shorten the time required for the temperature change. At the middle stage of heating, the low-power heating module 12 is switched to fine adjust the temperature of the compartment 10, so that the temperature of the compartment 10 accurately rises to the target temperature. Therefore, that the temperature of the compartment 10 of the refrigerator 1 is quickly and accurately adjusted is conducive to provide a storage environment with a wide temperature range that is flexibly adjusted for a user.

In a specific implementation, when both the high-power heating module 11 and the low-power heating module 12 are disposed in the compartment 10, during the successively controlling the high-power heating module 11 and the low-power heating module 12 to operate according to the current temperature of the compartment 10, the control method in this embodiment may further include: when the high-power heating module 11 is such controlled that the current temperature of the compartment 10 reaches a first preset temperature, stopping the operation of the high-power heating module 11, and starting the low-power heating module 12 to continue heating the compartment. Therefore, when the current temperature of the compartment 10 is gradually close to the target temperature, the low-power heating module 12 is switched, to effectively avoid the excessive temperature rise of the compartment 10 based on the advantages of the high control precision and the slight temperature fluctuation of the low-power heating module 12.

Because the humidity of the compartment 10 does not change obviously during the operation of the high-power heating module 11, the high-power heating module 11 and the low-power heating module 12 may be switched seamlessly, to shorten a total heating consumed time.

For example, a difference between the first preset temperature and the target temperature may be less than 5° C. to 10° C.

In a variant embodiment, when the high-power heating module 11 operates beyond a first preset time, the operation of the high-power heating module 11 is stopped, and the low-power heating module 12 starts to continue heating the compartment. Specifically, the first preset time may be determined according to a temperature change rate of the compartment 10 under the action of the high-power heating module 11. For example, a time required for the temperature of the compartment 10 to change from the current temperature in step S101 to the first preset temperature when the high-power heating module 11 operates according to a specified power is determined by means of theoretical calculation, experimental measurement, and the like. The time is the first preset time.

In a specific implementation, when the high-power heating module 11 is disposed in the evaporator compartment 15, during the successively controlling the high-power heating module 11 and the low-power heating module 12 to operate according to the current temperature of the compartment 10, the control method in this embodiment may further include: when the high-power heating module 11 is such controlled that the current temperature of the compartment 10 reaches a first preset temperature, stopping the operation of the high-power heating module 11, and starting dehumidification for the compartment 10; and after the dehumidification is completed, starting the low-power heating module 12 to continue heating the compartment 10. Therefore, by means of temperature control, the dehumidification is performed during the compartment 10 heating, to reduce the humidity of the compartment 10, and prevent stored items placed in the compartment 10 from deterioration and corruption. Further, the low-power heating module 12 is switched to continue heating after the dehumidification is completed, so that the compartment 10 can be heated to the target temperature in a humidity environment that meets requirements.

Because the high-power heating module 11 is disposed in the evaporator compartment 15, the evaporator 151 is defrosted synchronously during operation, resulting in a rise of the humidity of the compartment 10. Therefore, before the low-power heating module 12 is switched, the dehumidification may be first performed on the compartment 10.

In a variant embodiment, when the high-power heating module 11 operates beyond a first preset time, the operation of the high-power heating module 11 may be stopped, and dehumidification for the compartment 10 is started. That is, a starting time of the dehumidification is determined by means of a fixed time.

In a specific implementation, the dehumidification may include the following steps: starting the evaporator 151 for refrigeration, and acquiring an evaporator temperature of the evaporator 151; and when the evaporator temperature decreases to a preset dehumidification temperature, starting an air blower 16 to operate to blow air to circulate between the compartment 10 and the evaporator 151. Therefore, the dehumidification is performed on the compartment 10 by using a characteristic of a moisture absorption function when a temperature of the evaporator 151 is lower than a specified temperature, to reduce the humidity of the compartment 10. The preset dehumidification temperature may be −15° C.

In a specific implementation, the control method in this embodiment may further include: during the dehumidification for the compartment 10, when the current temperature of the compartment 10 reaches a preset dehumidification stopping temperature, stopping the dehumidification for the compartment 10 and stopping the operation of the air blower 16. Therefore, a stopping time of the dehumidification is determined by means of the temperature control, to actively stop the dehumidification when the humidity of the compartment 10 reaches an appropriate level.

Specifically, the preset dehumidification stopping temperature may be determined according to a condensation temperature under a current environmental condition of the compartment 10. For example, when the current temperature of the compartment 10 is lower than the condensation temperature, it indicates that condensation easily occurs in the compartment 10, and the dehumidification effect is poor, and therefore, the dehumidification may be stopped. In this case, both the evaporator 151 and the air blower 16 stop operating.

Alternatively, the preset dehumidification stopping temperature may be determined according to relative humidity acceptable when the compartment 10 is at the target temperature, to ensure that the humidity in the compartment 10 is also at an appropriate level as the temperature of the compartment 10 rises.

In a variant embodiment, when the dehumidification is continued to reach a second preset time, the dehumidification for the compartment 10 is stopped and the operation of the air blower 16 is stopped. Therefore, the stopping time of the dehumidification is determined by means of the fixed-time control, to also actively stop the dehumidification when the humidity of the compartment 10 reaches the appropriate level.

For example, the second preset time may be several minutes.

Similar to the first preset time, the second preset time may be determined according to a humidity change rate of the compartment 10 under the action of the high-power heating module 11, and may be further related to a frosting degree of the evaporator 151.

Figure 3:
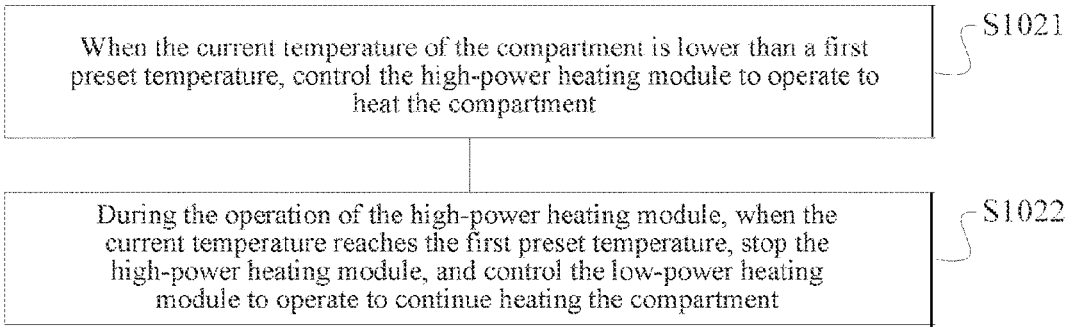
FIG. 3 is a flowchart of a specific implementation of step S102 in FIG. 2.

In a specific implementation, with reference to FIG. 3, step S102 may include the following steps:

Step S1021. When the current temperature of the compartment 10 is lower than a first preset temperature, control the high-power heating module 11 to operate to heat the compartment 10.

Step S1022. During the operation of the high-power heating module 11, when the current temperature reaches the first preset temperature, stop the high-power heating module 11, and control the low-power heating module 12 to operate to continue heating the compartment 10.

Therefore, when a difference between the current temperature of the compartment 10 and the target temperature is relatively large, the temperature quickly rises and the time required for the temperature change is shortened based on the high-power heating module. When the current temperature of the compartment 10 is gradually close to the target temperature, an excessive temperature rise is effectively avoided based on the low-power heating module 12. Further, during low-power heating, the temperature of the compartment 10 can be fine adjusted, to accurately rise the temperature of the compartment 10 to the target temperature. This has the advantages of high control precision and a slight temperature fluctuation, and is conducive to accurately maintain the temperature of the compartment 10 at the target temperature.

In step S1022, after the high-power heating module 11 stops, and before the low-power heating module 12 is controlled to operate, the foregoing dehumidification may be alternatively performed.

In a specific implementation, step S1021 may include: intermittently controlling the high-power heating module 11 to run to heat the compartment 10.

Because the heating effect of the heating module has hysteresis, and the heating of the heating module on the compartment 10 gradually acts on the whole compartment 10 from a partial portion of the compartment 10, a situation that local temperatures in the compartment 10 are uneven during heating may exist. In this case, a sufficient response time is provided through an intermittently heating mode, so that heat provided by the heating module (for example, the high-power heating module 11) can be sufficiently radiated to each area of the compartment 10, to prevent the measured current temperature of the compartment 10 from being falsely high or low caused by the uneven local temperatures in the compartment 10.

Further, more accurate temperature measurement results are conducive to reasonably determine a switching time of the two heating modules, to accurately switch to, at the first preset temperature, the low-power heating module 12 to operate.

Further, during intermittent operation, the current temperature of the compartment 10 may be continuously acquired, to determine whether to stop the operation of the high-power heating module 11.

In a specific implementation, a time interval between two successive runnings of the high-power heating module 11 may be related to the number of times of runnings of the high-power heating module 11, so that heat generated and accumulated during previous runnings of the heating module can have sufficient response time to be transferred to the compartment 10. Therefore, the temperature evenness in the compartment 10 is better ensured, so that the measurement result for the temperature of the compartment 10 can more accurately reflect an actual temperature level of the compartment 10.

In a specific implementation, a running duration of each running of the high-power heating module 11 may be determined according to an evaporator temperature of the evaporator 151. Further, the evaporator temperature may be related to a thickness of frost on the evaporator 151.

In a specific implementation, before step S1021, the control method in this embodiment may further include: controlling the high-power heating module to run to perform a preheating operation; controlling an air blower 16 related to the compartment 10 to switch on to blow air to circulate between the high-power heating module 11 and the compartment 10; and if the current temperature of the compartment 10 is still lower than the first preset temperature after the preheating operation is completed, controlling the high-power heating module 11 to operate to heat the compartment 10.

Specifically, the preheating operation may also be understood as a pre-defrosting operation, and can play a role of warming the machine, so that when the high-power heating module 11 is subsequently controlled to operate to heat the compartment 10, the heat provided by the high-power heating module 11 can be quickly radiated to the compartment 10.

Further, the added preheating operation is further conducive to reasonably determine subsequent control logic. For example, when the temperature of the compartment 10 can rise to the first preset temperature through the preheating operation, the low-power heating module 12 may be directly controlled to fine adjust the temperature. In another example, when the temperature of the compartment 10 is still relatively low after the preheating is completed, the high-power heating module 11 is controlled to heat to quickly rise the temperature.

In the solution of this embodiment, during heating by using the defrosting heating wire of the evaporator compartment 15, through a running control of a prior pre-defrosting and a subsequent dehumidification, not only the heating speed is increased, but also excessive water vapor is prevented from being brought to the variable-temperature compartment, thereby helping avoid deterioration of stored food in the compartment 10.

Further, the if the current temperature of the compartment 10 is still lower than the first preset temperature after the preheating operation is completed, controlling the high-power heating module 11 to operate to heat the compartment 10 includes: waiting for a first preset response duration after the preheating operation is completed; and if the current temperature of the compartment 10 is still lower than the first preset temperature after the first preset response duration is waited for, controlling the high-power heating module 11 to operate to heat the compartment 10. Therefore, the sufficient response time is also provided after the preheating is completed, to ensure that the heat of the high-power heating module 11 is sufficiently radiated to the compartment 10.

Further, the first preset response duration may be determined according to the evaporator temperature. This depends on the amount of frost on the evaporator 151.

In a specific implementation, during the controlling the high-power heating module 11 to operate to heat the compartment 10, the air blower 16 related to the compartment 10 may be in an on state, to increase the radiation speed of the heat between the high-power heating module 11 and the compartment 10 and the heat in the each area of the compartment 10.

In a specific implementation, in step S1022, the controlling the low-power heating module 12 to operate to heat the compartment 10 may include: intermittently controlling the low-power heating module 12 to run to heat the compartment 10; and during the running of the low-power heating module 12, controlling the air blower 16 related to the compartment 10 to switch on to blow air to flow in the compartment 10.

Therefore, the sufficient response time is provided through an intermittently heating mode, and the temperature radiation speed is improved in combination with the air blower 16, so that the heat provided by the low-power heating module 12 can be sufficiently and quickly radiated to the each area of the compartment 10.

Further, during intermittent operation, the current temperature of the compartment 10 may be continuously acquired and whether the current temperature reaches the target temperature may be determined, so as to determine whether to stop the operation of the low-power heating module 12.

Further, a smaller second operating power indicates a greater ratio of a single running duration of the low-power heating module 12 to a time interval between two successive runnings of the low-power heating module 12, and therefore, the temperature fluctuation is reduced.

Figure 4:
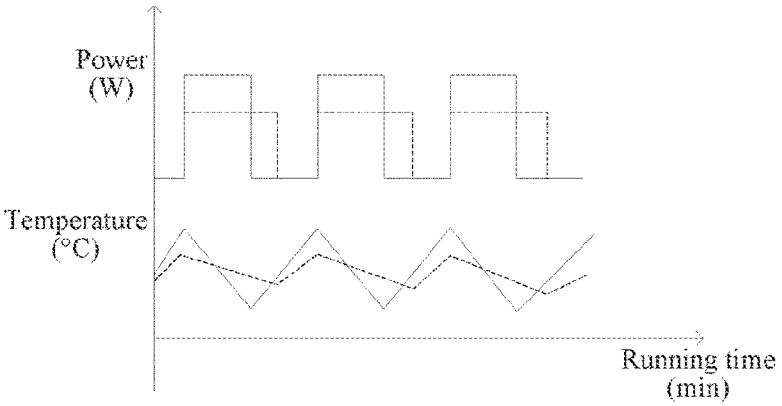
FIG. 4 is a curve of a relationship between a running time, a power, and a temperature of a heating module according to an embodiment of the present invention.

For example, referring to FIG. 4, a lower power of the low-power heating module 12 indicates a larger $t_{on}/t_{off}$ ratio of the low-power heating module 12 and a slighter temperature fluctuation. In other words, a difference between the heating modules with different powers may be similar to a constant-frequency compressor and a variable frequency compressor.

In a specific implementation, in step S1022, after the high-power heating module 11 stops, and before the low-power heating module 12 is controlled to operate, step S102 may further include: waiting for a second preset response duration after the high-power heating module 11 is switched off; and if the current temperature of the compartment 10 is still lower than the first preset temperature after the second preset response duration is waited for, controlling the low-power heating module 12 to operate. Therefore, determining whether to continue heating after waiting for the sufficient response time is conducive to more accurately adjust the temperature of the compartment 10.

In a specific implementation, the control method in this embodiment may further include: during the controlling the low-power heating module 12 to operate, when the current temperature of the compartment 10 is higher than a second preset temperature, controlling the low-power heating module 12 to stop heating the compartment 10, where the second preset temperature is higher than the first preset temperature, and the second preset temperature is lower than the target temperature. Therefore, the low-power heating module 12 is switched off in advance before the temperature of the compartment 10 reaches the target temperature, to reserve the sufficient response time for a change of the temperature of the compartment 10, so as to ensure that the temperature of the compartment 10 accurately reaches and is maintained at the target temperature.

It is better to avoid that the compartment 10 is heated beyond the target temperature.

For example, a difference between the second preset temperature and the target temperature may be 1° C. to 2° C.

In a typical application scenario in the embodiments shown in FIG. 1 to FIG. 4, the refrigerator 1 may include the high-power defrosting heating wire (that is, the high-power heating module 11) and the low-power compensation heating wire (that is, the low-power heating module 12). During the variable-temperature compartment (that is, the compartment 10) heating, the high-power defrosting heating wire is first used for heating, and the low-power compensation heating wire is then used for heating, to quickly and accurately adjust the temperature of the variable-temperature compartment to the target temperature.

Further, the high-power defrosting heating wire is disposed in the evaporator compartment 15, and the low-power compensation heating wire is disposed in the variable-temperature compartment.

During temperature control of the variable-temperature compartment, the high-power defrosting heating wire is first invoked for heating, the low-power compensation heating wire is then invoked for heating, and a switching time between the two heating wires is determined according to a temperature difference between the current temperature of the variable-temperature compartment and the target temperature. In addition, a dehumidification mode is entered immediately after the defrosting heating wire stops operating. After the dehumidification, the low-power compensation heating wire is then invoked for heating, so that the temperature of the variable-temperature compartment is slowly close to the target temperature.

Alternatively, both the two heating wires may be disposed in the variable-temperature compartment and successively heat the variable-temperature compartment under the control of the control module 14. In this case, the dehumidification may be omitted.

Figure 5:
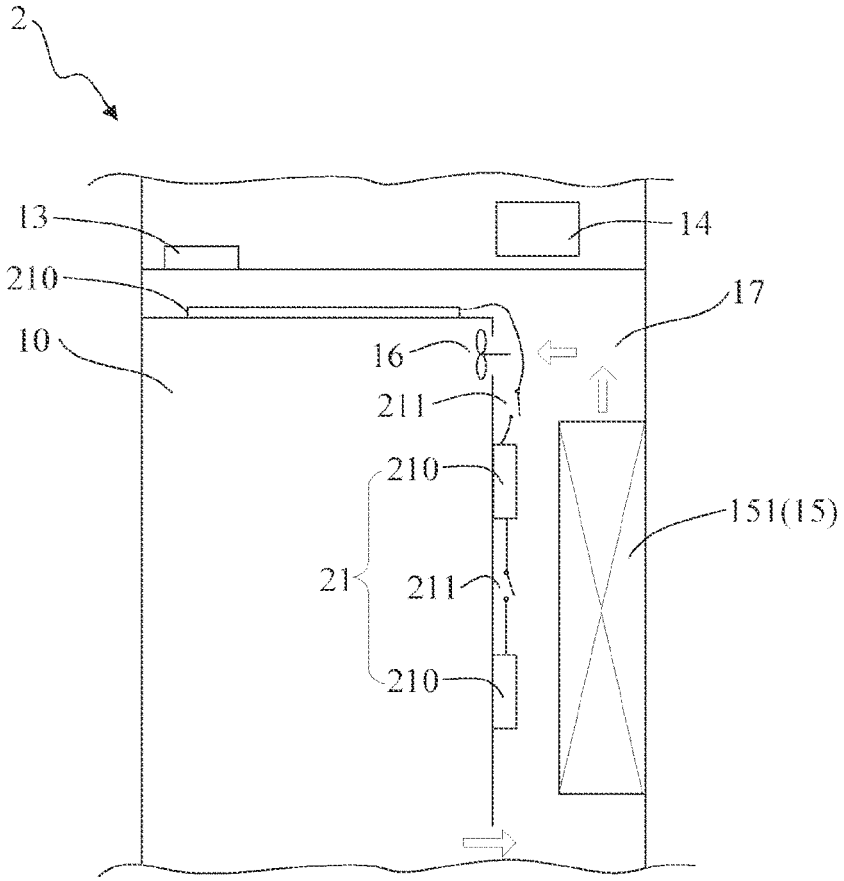
FIG. 5 is a schematic diagram of a principle of a second refrigerator according to an embodiment of the present invention.
Figure 6:
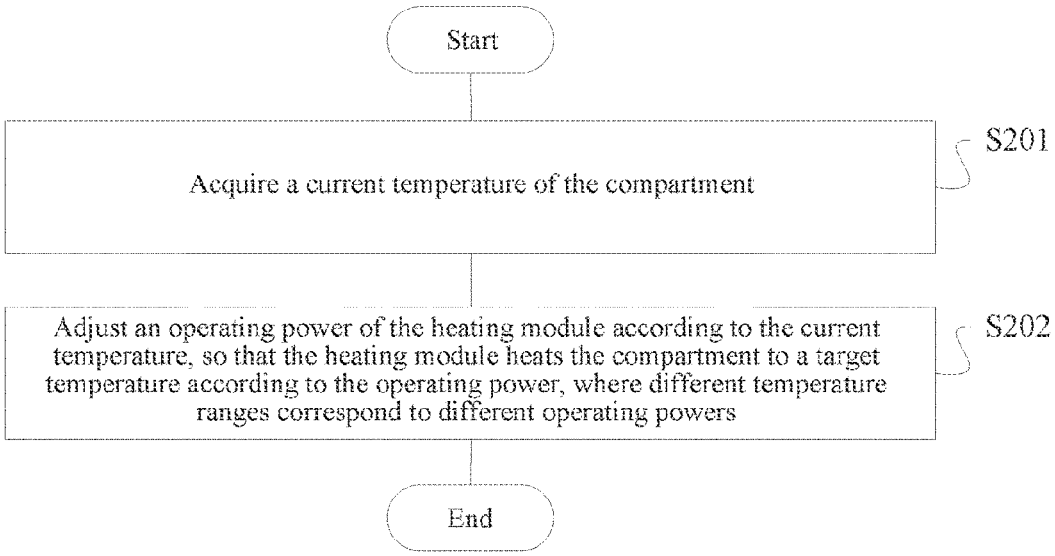
FIG. 6 is a flowchart of a control method for the refrigerator shown in FIG. 5.

FIG. 5 is a schematic diagram of a principle of a second refrigerator according to an embodiment of the present invention. FIG. 6 is a flowchart of a control method for the refrigerator shown in FIG. 5.

A temperature of a compartment of the refrigerator 2 shown in FIG. 5 can be quickly and accurately adjusted by using the solution of this embodiment. It should be noted that, FIG. 5 merely exemplarily shows a specific structure of a compartment 10 controlled by using the control method shown in FIG. 6.

For example, the compartment 10 may be a variable-temperature compartment. In actual application, the compartment 10 may be another area of the refrigerator 2 where a temperature needs to be adjusted.

Specifically, referring to FIG. 5, in this embodiment, the refrigerator 2 may include: a compartment 10; a heating module 21, where the heating module 21 includes a plurality of sets of heating units 210, the plurality of sets of heating units 210 are connected through a control switch 211, and operating powers of the heating module 21 are different when the control switch 211 switches on and off; a temperature sensor 13, disposed in the compartment 10 and configured to acquire a current temperature of the compartment 10; and a control module 14, coupled to the heating module 21 and the temperature sensor 13 respectively, where the control module 14 is configured to receive a user instruction and perform the control method described in the embodiments shown in FIG. 6 in response to the user instruction, to adjust the temperature of the compartment 10 to a target temperature indicated by the user instruction.

Further, the refrigerator 2 may further include: an evaporator compartment 15. The evaporator compartment 15 is provided with an evaporator 151. The evaporator compartment 15 and the compartment 10 are connected by using an air duct 17. The air duct 17 is provided with an air blower 16.

Referring to FIG. 6, the control method for the refrigerator 2 may include the following steps: Step S201. Acquire a current temperature of the compartment.

Step S202. Adjust an operating power of the heating module according to the current temperature, so that the heating module heats the compartment to a target temperature according to the operating power, where different temperature ranges correspond to different operating powers.

For structures of the temperature sensor 13, the control module 14, the evaporator 151, and the like, refer to the foregoing related descriptions in the first embodiment shown in FIG. 1. Details are not described herein.

In a specific implementation, the plurality of sets of heating units 210 may be distributed on different positions of the compartment 10. For example, the plurality of sets of heating units 210 may be dispersedly disposed on different walls of the compartment 10.

Further, the heating units 210 may be coupled to each other by using the control switch 211. In response to a control instruction of the control module 14, the control switch 211 switches on and off to adjust a quantity and positions of the heating units 210 in a running state. Operating powers of the heating units 210 may be the same, or may be different. More switched-on control switches 211 indicates more heating units 210 in a running state, and correspondingly, an operating power of the heating module 21 is higher.

In a variant embodiment, the plurality of sets of heating units 210 may be disposed in different areas of the refrigerator 2. For example, the plurality of sets of heating units 210 may include a compensation heating wire disposed in the compartment 10, and may further include a defrosting heating wire disposed in the evaporator compartment 15. The control module 14 may separately control, by using the control switch 211, whether the two heating wires are in a running state or a non-operation state, so that the heating module 21 heats the compartment 10 at different operating powers.

In view of the above, the temperature of the compartment 10 of the refrigerator 2 can be quickly and accurately adjusted by using the solution of this embodiment. Specifically, a quantity of heating units 210 in an operation state is adjusted according to the current temperature range of the compartment 10, to adjust the operating power of the heating module 21, so that the heating module 21 can operate at a power more suitable for a current state of the compartment 10. The solution of this embodiment is conducive to provide a storage environment with a wide temperature range that is flexibly adjusted for a user.

In a specific implementation, when the heating module 21 performs a defrosting heating function, the control method in this embodiment may further include: when the current temperature of the compartment 10 reaches a first preset temperature and the first preset temperature is lower than the target temperature, pausing the operation of the heating module 21, and starting dehumidification for the compartment 10. Therefore, by means of temperature control, the dehumidification is performed during the compartment 10 heating, to reduce the humidity of the compartment 10, and prevent stored items placed in the compartment 10 from deterioration and corruption.

For example, when the heating module 21 includes the defrosting heating wire disposed in the evaporator compartment, to avoid excessively large humidity in the compartment 10 during the heating, the dehumidification may be performed on the compartment 10 when the temperature of the compartment 10 is close to the target temperature.

Specifically, a difference between the first preset temperature and the target temperature may be less than 5° C. to 10° C., to start the dehumidification when the temperature of the compartment 10 is close to the target temperature. Specifically, the dehumidification is started when the temperature of the compartment 10 rises near the target temperature, and the humidity of the compartment 10 may be adjusted to an appropriate level through single-time dehumidification instead of multi-time repeated dehumidification, thereby reducing the power consumption of the refrigerator 2.

In a variant embodiment, when the heating module 21 operates beyond a first preset time, the operation of the heating module 21 may be paused, and dehumidification for the compartment 10 is started. That is, a starting time of the dehumidification is determined by means of a fixed time.

In a specific implementation, the dehumidification may include the following steps: starting the evaporator 151 for refrigeration, and acquiring an evaporator temperature of the evaporator 151; and when the evaporator temperature decreases to a preset dehumidification temperature, starting an air blower 16 to operate to blow air to circulate between the compartment 10 and the evaporator 151. Therefore, the dehumidification is performed on the compartment 10 by using a characteristic of a moisture absorption function when a temperature of the evaporator 151 is lower than a specified temperature, to reduce the humidity of the compartment 10. The preset dehumidification temperature may be −15° C.

In a specific implementation, the control method in this embodiment may further include: during the dehumidification for the compartment 10, when the current temperature of the compartment 10 reaches a preset dehumidification stopping temperature, stopping the dehumidification for the compartment 10 and stopping the operation of the air blower 16. Therefore, a stopping time of the dehumidification is determined by means of the temperature control, to actively stop the dehumidification when the humidity of the compartment 10 reaches an appropriate level.

Specifically, the preset dehumidification stopping temperature may be determined according to a condensation temperature under a current environmental condition of the compartment 10. For example, when the current temperature of the compartment 10 is lower than the condensation temperature, it indicates that condensation easily occurs in the compartment 10, and the dehumidification effect is poor, and therefore, the dehumidification may be stopped. In this case, both the evaporator 151 and the air blower 16 stop operating.

Alternatively, the preset dehumidification stopping temperature may be determined according to relative humidity acceptable when the compartment 10 is at the target temperature, to ensure that the humidity in the compartment 10 is also at an appropriate level as the temperature of the compartment 10 rises.

In a variant embodiment, when the dehumidification is continued to reach a second preset time, the dehumidification for the compartment 10 is stopped and the operation of the air blower 16 is stopped. Therefore, the stopping time of the dehumidification is determined by means of the fixed-time control, to also actively stop the dehumidification when the humidity of the compartment 10 reaches the appropriate level.

For example, the second preset time may be several minutes.

Similar to the first preset time, the second preset time may be determined according to a humidity change rate of the compartment 10 under the action of the high-power heating module 11, and may be further related to a frosting degree of the evaporator 151.

Figure 7:
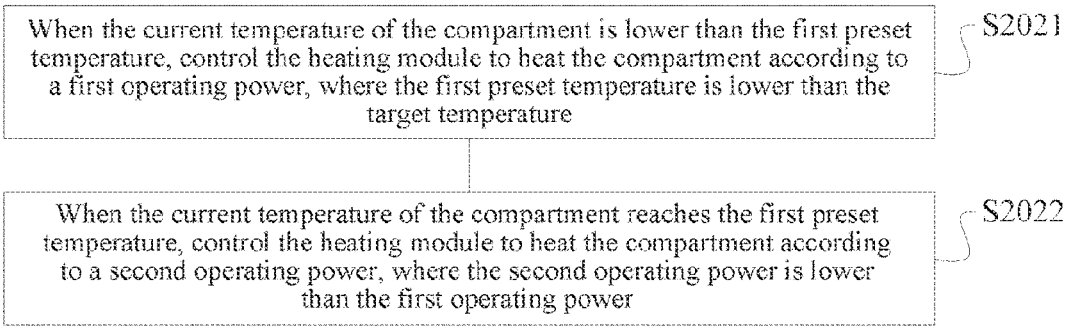
FIG. 7 is a flowchart of a specific implementation of step S202 in FIG. 6.

In a specific implementation, with reference to FIG. 7, step S202 may include the following steps:

Step S2021. When the current temperature of the compartment 10 is lower than the first preset temperature, control the heating module 21 to heat the compartment 10 according to a first operating power, where the first preset temperature is lower than the target temperature.

Step S2022. When the current temperature of the compartment 10 reaches the first preset temperature, control the heating module 21 to heat the compartment 10 according to a second operating power, where the second operating power is lower than the first operating power.

For example, the heating module 21 operating according to the first operating power may be similar to the foregoing high-power heating module 11 described in the embodiment shown in FIG. 1, and the heating module 21 operating according to the second operating power may be similar to the foregoing low-power heating module 12 described in the embodiment shown in FIG. 1.

Therefore, when a difference between the current temperature of the compartment 10 and the target temperature is relatively large, the operating power of the heating module 21 can be appropriately increased, to quickly rise the temperature, and shorten the time required for a temperature change. When the current temperature of the compartment 10 is gradually close to the target temperature, the operating power of the heating module 21 can be appropriately decreased, to effectively avoid an excessive temperature rise.

Further, during low-power heating, the temperature of the compartment 10 can be fine adjusted, to accurately rise the temperature of the compartment 10 to the target temperature. This has the advantages of high control precision and a slight temperature fluctuation, and is conducive to accurately maintain the temperature of the compartment 10 at the target temperature.

In a specific implementation, step S2021 may include: intermittently controlling the heating module 21 to run according to the first operating power to heat the compartment 10.

Because the heating effect of the heating module 21 has hysteresis, and the heating for the compartment 10 gradually acts on the whole compartment 10 from a partial portion of the compartment 10, a situation that local temperatures in the compartment 10 are uneven during heating may exist. In this case, a sufficient response time is provided through an intermittently heating mode, so that heat provided by the heating module 21 can be sufficiently radiated to each area of the compartment 10, to prevent the measured current temperature of the compartment 10 from being falsely high or low caused by the uneven local temperatures in the compartment 10. Further, more accurate temperature measurement results are conducive to reasonably determine the operating power adjustment time of the heating module 21, so that the heating module 21 can be accurately switched to the second operating power at the first preset temperature.

Further, a time interval between two successive runnings of the heating module 21 is related to the number of times of runnings of the heating module 21, so that heat generated and accumulated during previous runnings of the heating module 21 can have the sufficient response time to be transferred to the compartment 10. Therefore, the temperature evenness in the compartment 10 is better ensured, so that the measurement result for the temperature of the compartment 10 can more accurately reflect an actual temperature level of the compartment 10.

In a specific implementation, the control method in this embodiment may further include: during the controlling the heating module 21 to heat the compartment 10 according to a first operating power, when the current temperature rises to the first preset temperature, controlling the heating module 21 to switch to heat the compartment 10 at the second operating power; and during the controlling the heating module 21 to heat the compartment 10 according to a second operating power, when the current temperature continues to rise beyond a second preset temperature, controlling the heating module 21 to stop heating the compartment 10, where the second preset temperature is higher than the first preset temperature, and the second preset temperature is lower than the target temperature.

Because the first operating power is higher, a variation of the temperature of the compartment 10 within a unit time is correspondingly larger. Therefore, the heating module 21 is controlled to first heat the compartment 10 according to a higher first operating power, so that the compartment 10 is quickly heated to a temperature near the target temperature.

Further, considering that there may be a delay in the measurement of the temperature of the compartment 10, and a time is also required to achieve the temperature evenness in the each area in the compartment 10, if the heating module 21 stops running after heating the compartment 10 to the target temperature by using the first operating power all the time, an actual temperature in the compartment 10 may have been beyond the target temperature. Therefore, in the solution of this embodiment, when the temperature of the compartment 10 reaches the first preset temperature, the heating module 21 is controlled to switch to heat the compartment 10 at a smaller second operating power, so that the temperature of the compartment 10 can slowly rise to the target temperature. Because the second operating power is lower, a variation of the temperature of the compartment 10 within a unit time is correspondingly smaller. Therefore, the fluctuation of the temperature of the compartment 10 is slight, and a situation that the temperature rises sharply does not exist, so that it is possible for the temperature of the compartment 10 to accurately be the target temperature.

Further, the heating module 21 is switched off in advance before the temperature of the compartment 10 reaches the target temperature, to reserve the sufficient response time for a change of the temperature of the compartment 10, so as to ensure that the temperature of the compartment 10 accurately reaches and is maintained at the target temperature. It is better to avoid that the compartment 10 is heated beyond the target temperature.

The second preset temperature may be determined according to a refrigeration shutdown temperature of the compartment 10, a temperature correction of the heating module 21, and a switch difference of the heating module 21. The temperature correction of the heating module 21 is related to the current temperature of the compartment 10. The switch difference of the heating module 21 is used for representing a temperature variation of the compartment 10 during single running of the heating module 21.

In a specific implementation, step S2022 may include: intermittently controlling the heating module 21 to run according to the second operating power to heat the compartment 10; and during the running of the heating module 21, controlling the air blower 16 of the refrigerator 2 to switch on to blow air to circulate between the compartment 10 and the heating module 21. Therefore, the sufficient response time is provided through an intermittently heating mode, and the temperature radiation speed is improved in combination with the air blower 16, so that the heat provided by the heating module 21 can be sufficiently and quickly radiated to the each area of the compartment 10.

Although specific implementations have been described above, the implementations are not intended to limit the scope of the present disclosure, even if only one implementation is described with respect to specific features. The feature example provided in the present disclosure is intended to illustrate, but not limit, unless otherwise stated. In specific implementations, the technical features of one or more dependent claims may be combined with the technical features of the independent claims, and the technical features from the corresponding independent claims may be combined in any appropriate manner, rather than only in the specific combinations listed in the claims.

An embodiment of the invention comprises a refrigerator 2, comprising a compartment 10;

a heating module 21, wherein the heating module 21 comprises a plurality of sets of heating units 210, the plurality of sets of heating units 210 are connected through a control switch 211, and operating powers of the heating module 21 are different when the control switch 211 switches on and off;

a temperature sensor 13, disposed in the compartment 10 and configured to acquire a current temperature of the compartment 10; and a control module 14, coupled to the heating module 21 and the temperature sensor 13 respectively, wherein the control module 14 is configured to receive a user instruction and perform the control method according to any one a method of the invention in response to the user instruction, to adjust the temperature of the compartment 10 to a target temperature indicated by the user instruction.

According to an embodiment of the invention the high-power heating module 12 comprises an evaporator defrost heater.

Although the present invention is disclosed above, the present invention is not limited thereto. Any person skilled in the art can make various variations and modifications without departing from the spirit and the scope of the present invention. Therefore, the protection scope of the present invention should be subject to the scope defined by the claims.

What is claimed is:

1. A control method for a refrigerator, the refrigerator having a compartment, an evaporator, and a heater, which comprises the steps of:

acquiring a current temperature of the compartment;

adjusting an operating power of the heater according to the current temperature, so that the heater heats the compartment to a target temperature according to the operating power, wherein different temperature ranges correspond to different operating powers; and pausing an operation of the heater and starting dehumidification of the compartment when the current temperature of the compartment reaches a first preset temperature and the first preset temperature is lower than the target temperature, or when the heater operates beyond a first preset time.

2. The control method according to claim 1, wherein the dehumidification comprises the further steps of:

starting the evaporator for refrigeration;

acquiring an evaporator temperature of the evaporator; and starting an air blower to operate to blow air to circulate between the compartment and the evaporator when the evaporator temperature decreases to a preset dehumidification temperature.

3. The control method according to claim 2, which further comprises during the dehumidification for the compartment, when the current temperature of the compartment reaches a preset dehumidification stopping temperature, or when the dehumidification is continued to reach a second preset time, stopping the dehumidification for the compartment and stopping an operation of the air blower.

4. The control method according to claim 1, wherein a difference between the first preset temperature and the target temperature is less than 5° C. to 10° C.

5. The control method according to claim 1, wherein the adjusting of the operating power of the heater according to the current temperature, so that the heater heats the compartment to the target temperature according to the operating power, further comprises the substeps of:

controlling the heater to heat the compartment according to a first operating power when the current temperature of the compartment is lower than the first preset temperature, wherein the first preset temperature is lower than the target temperature; and controlling the heater to heat the compartment according to a second operating power when the current temperature of the compartment reaches the first preset temperature, wherein the second operating power is lower than the first operating power.

6. The control method according to claim 5, wherein the step of controlling the heater to heat the compartment according to the first operating power further comprises intermittently controlling the heater to run according to the first operating power to heat the compartment.

7. The control method according to claim 6, wherein a time interval between two successive runnings of the heater is related to a number of times of runnings of the heater.

8. The control method according to claim 5, which further comprises:

during the controlling of the heater to heat the compartment according to the first operating power, when the current temperature rises to the first preset temperature, controlling the heater to switch to heat the compartment at the second operating power; and during the controlling of the heater to heat the compartment according to the second operating power, when the current temperature continues to rise beyond a second preset temperature, controlling the heater to stop heating the compartment, wherein the second preset temperature is higher than the first preset temperature, and the second preset temperature is lower than the target temperature.

9. The control method according to claim 5, wherein the step of controlling the heater to heat the compartment according to the second operating power further comprises:

intermittently controlling the heater to run according to the second operating power to heat the compartment; and during a running of the heater, controlling an air blower of the refrigerator to switch on to blow air to circulate between the compartment and the heater.

10. The control method according to claim 5, wherein the heater includes a high-power heater and a low-power heater, wherein the high-power heater operates at and provides the first operating power and the low-power heater operates at and provides the second operating power, wherein the second operating power is lower than the first operating power.

11. The control method according to claim 1, wherein the heater includes a defrosting heating wire disposed in an evaporator compartment of the refrigerator.

12. The control method according to claim 11, wherein the defrosting heating wire is a high-power defrosting heating wire disposed in the evaporator compartment, and a low-power compensation heating wire is disposed in the compartment.

13. The control method according to claim 1, wherein the compartment is a variable-temperature compartment.

14. A refrigerator, comprising:

a compartment;

a high-power heater configured to heat said compartment according to a first operating power;

a low-power heater configured to heat said compartment according to a second operating power, wherein the second operating power is lower than the first operating power;

a temperature sensor disposed in said compartment and configured to acquire a current temperature of said compartment; and a controller coupled to said high-power heater, said low-power heater, and said temperature sensor respectively, wherein said controller is configured to receive a user instruction to adjust the current temperature of said compartment to a target temperature indicated by the user instruction, said controller programmed to:

acquire the current temperature of said compartment;

adjust the first operating power and the second operating power according to the current temperature, so that at least one of the high-power heater or the low-power heater heat the compartment to the target temperature, wherein different temperature ranges correspond to different operating powers; and pause an operation of said high-power heater and said low-power heater and starting dehumidification of said compartment when the current temperature of said compartment reaches a first preset temperature and the first preset temperature is lower than the target temperature, or when at least one said high-power heater or said low-power heater operates beyond a first preset time.

15. The refrigerator according to claim 14, further comprising an evaporator compartment, said high-power heater is disposed in said compartment or in said evaporator compartment.

16. The refrigerator according to claim 14, wherein said low-power heater is disposed in said compartment.

17. The refrigerator according to claim 14, wherein said high-power heater has an evaporator defrost heater.

* * * * *